United States Patent [19]

Morioka et al.

[11] 3,951,355

[45] Apr. 20, 1976

[54] AUTOMATIC CABLE WINDING APPARATUS

[75] Inventors: Joji Morioka; Takuzo Matsumoto, both of Osaka; Kanji Otani; Katsuhisa Uedono, both of Yokohama, all of Japan

[73] Assignee: Sumitomo Electric Industries, Ltd., Osaka, Japan

[22] Filed: Aug. 30, 1974

[21] Appl. No.: 501,929

[52] U.S. Cl. ..... 242/158 R; 242/158.4 R

[51] Int. Cl.[2] ..... B65H 54/28

[58] Field of Search ..... 242/158 R, 158 F, 158.2, 242/158.4 R, 158.4 A, 25 R, 7.14, 7.15, 7.16

[56] References Cited

UNITED STATES PATENTS

| | | | |
|---|---|---|---|
| 2,845,229 | 7/1958 | Bliss | 242/158.4 R X |
| 2,988,292 | 6/1961 | Bliss | 242/158.4 R X |
| 3,319,070 | 5/1967 | Schneider | 242/158 R X |
| 3,498,567 | 3/1970 | Baker et al. | 242/158.4 R |
| 3,507,458 | 4/1970 | Merchant et al. | 242/158.4 R |
| 3,544,035 | 12/1970 | Woolever | 242/158 R |
| 3,669,380 | 6/1972 | Caltagirone | 242/158 R |
| 3,779,480 | 12/1973 | Cambou | 242/158 R |
| 3,829,037 | 8/1974 | Sallin | 242/158.2 |

FOREIGN PATENTS OR APPLICATIONS

| | | | |
|---|---|---|---|
| 1,267,507 | 5/1968 | Germany | 242/158 R |

*Primary Examiner*—Stanley N. Gilreath
*Attorney, Agent, or Firm*—Sughrue, Rothwell, Mion, Zinn & Macpeak

[57] ABSTRACT

An automatic cable winding apparatus comprises a traverse arm mounted to the traverse block sliding on a traverse base that guides cables to be wound on the drum and provided near the top thereof with guide rollers guiding said cables while supporting them from the upper and the lower sides thereof and a presser roller pressing the cables sideways, a device giving pressing force to said traverse arm, proximity switches detecting that the cables are wound up to the vicinity of the flange of the drum, a rotation angle detector which causes said traverse base to stop by the detection signals generated from said proximity switches and detects the rotation angle of the drum, another device for quickly advancing and retracting said traverse block relative to the flanges of the drum when said rotation angle detector detects that the drum has been rotated by a predetermined angle, and a device for raising the traverse apparatus by the height of the outer diameter of the cable every time a new layer of cable is wound on the drum.

10 Claims, 20 Drawing Figures

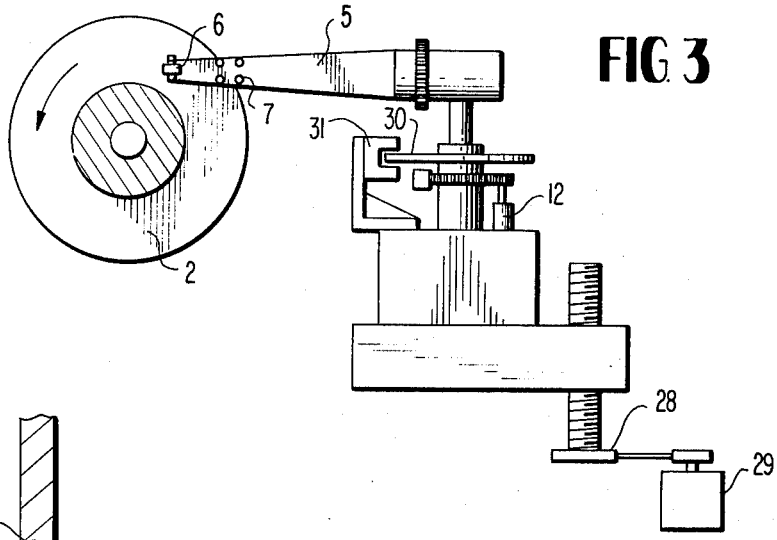
FIG. 3
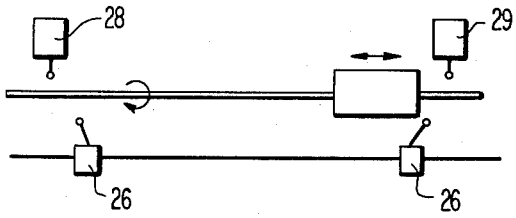
FIG. 4
FIG. 5
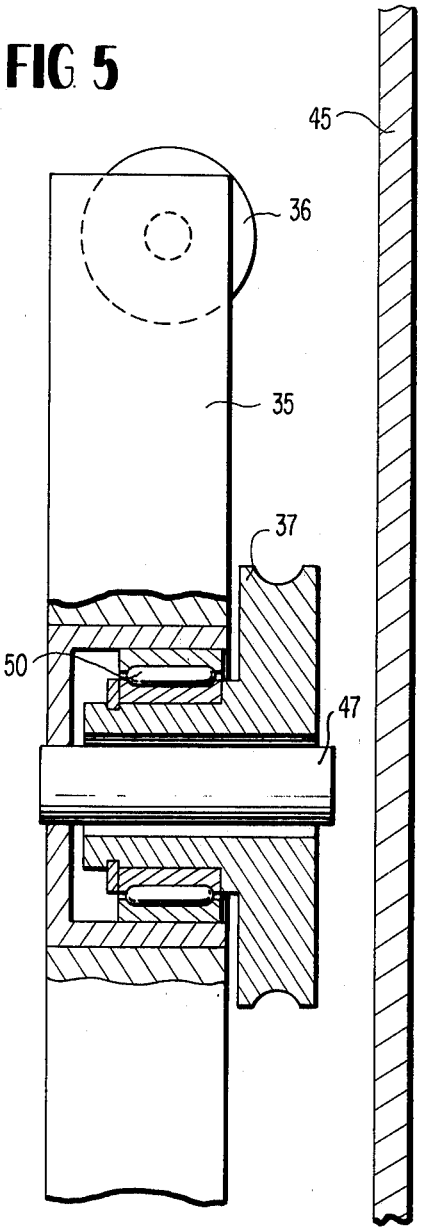
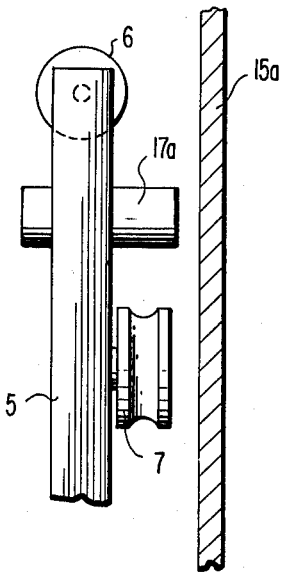
FIG. 6
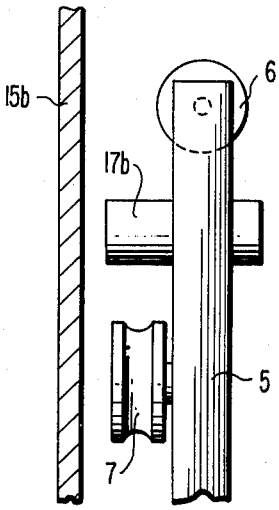
FIG. 7

FIG. 11
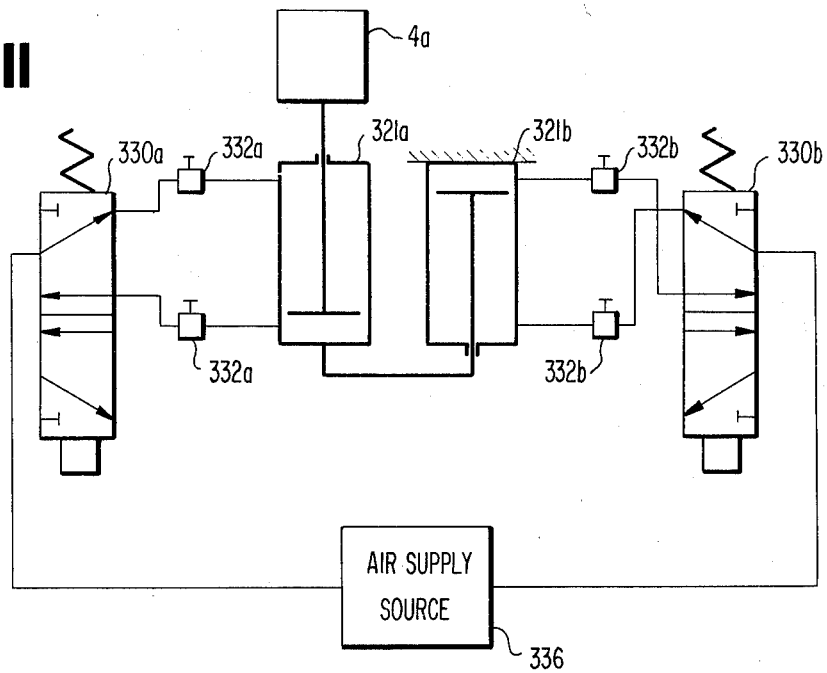
FIG. 12
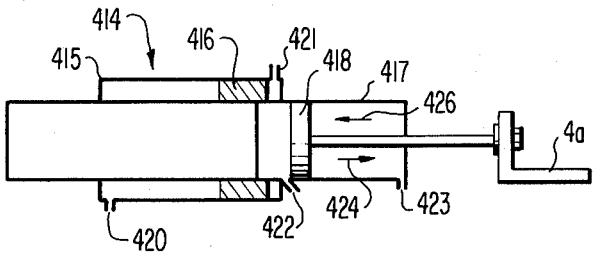
FIG. 13a
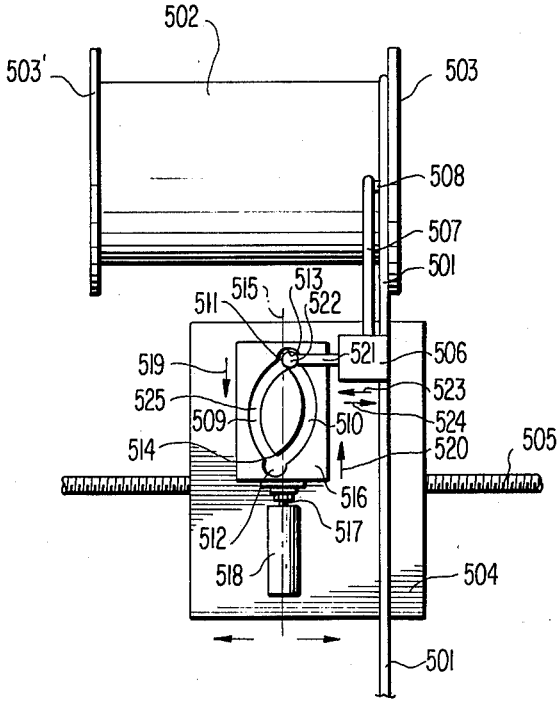
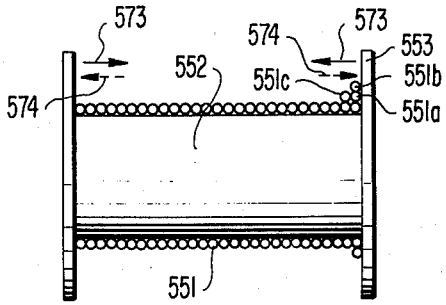
FIG. 13b

FIG. 14
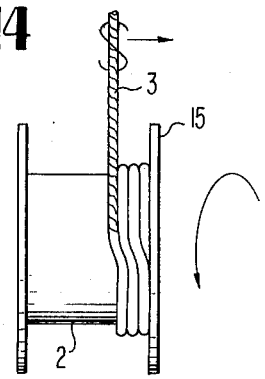
FIG. 15
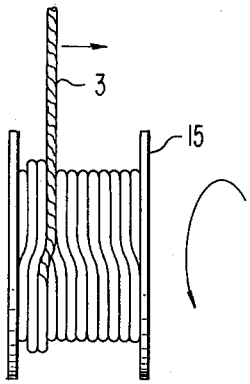
FIG. 16
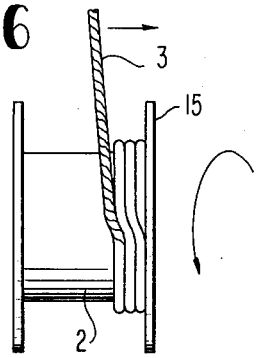
FIG. 17
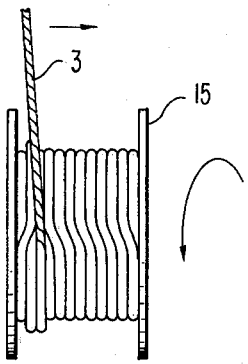
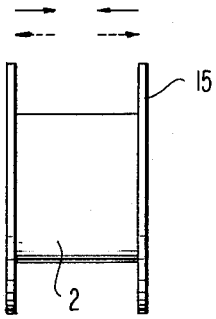
FIG. 18

AUTOMATIC CABLE WINDING APPARATUS

BACKGROUND OF THE INVENTION

Field of the Invention

This invention relates to an apparatus for automatically winding cables in order. Cables have usually been wound in order when they are taken up into a drum. In particular, a shipping drum and a traverse apparatus for guiding the cables is usually provided in order to wind the cables in good order. When the cables are sequentially wound around the drum up to the vicinity of the flange of the drum, the movement of a traverse base of the traverse apparatus is stopped temporarily and, after the formation of the succeeding layer of cables at the flange, the direction of the movement of the traverse base is reversed to form the winding of the succeeding layer sequentially. However, it is difficult to achieve complete formation of the secceeding layer at the change of direction for forming said succeeding layer by merely reversing the moving direction of the traverse base because the cables tend to run on or apart from adjacent ones, etc. and such a change must be done manually. This is an obstacle to the complete automation of the cable winding and even provides dangers when winding cables at high speed around the drum.

SUMMARY OF THE INVENTION

A primary object of this invention is to provide an apparatus capable of winding cables closely in order around the drum in a plurality of layers thoroughly automatically.

Another object of this invention is to wind cables closely in order around the drum wherein the winding direction of the cables are changed automatically.

Another object of this invention is to detect accurately when the cables are wound up to the vicinity of the flange of the drum.

Another object of this invention is to wind cables closely in order while pressing them onto the flange of the drum even when the outer periphery of the flange expands radially as the cables are wound on the drum.

Another object of this invention is to provide a traverse arm having guide rollers, proximity switches and vertical rollers wherein the proximity switches can be situated together with the guide rollers near the top of the traverse arm.

Another object of this invention is to provide easy control for quick feed and quick return of the traverse block on the traverse base and to provide a brake mechanism for preventing the traverse arm from rolling.

Still another object of this invention is to wind cables closely in order while effecting appropriate control on the twisted cables depending upon the twist direction or habit of winding thereof.

BRIEF DESCRIPTION OF THE DRAWING

Other objects and advantages will be apparent from the following descriptions, the accompanying drawings and the appended claims, in which:

FIG. 3 is a side view illustrating the realtion between the traverse base and the drum;

FIG. 4 is a schematic view for illustrating the arrangement of the proximity switches;

FIG. 5 is a partially cut away sectional view for illustrating the mounting of the proximity switch;

FIG. 6 and FIG. 7 are the schematic view for illustrating the mounting of the proximity switch over and under the top of the traverse arm respectively;

FIG. 11 is a schematic view for illustrating the another disposition of the double cylinder;

FIG. 12 is a sectional view illustrating the structure of a dual cylinder:

FIG. 13*a* is a schematic view illustrating another type of quick return and quick feed mechanism using a grooved cam;

FIG. 13*b* is a schematic view for illustrating the winding of the calbes near the flange using a grooved cam;

FIG. 14 is a schematic view for illustrating the running on tendency of the calbes;

FIG. 15 is a schematic view for illustrating the aparting tendency of the cables;

FIG. 16 is a schematic view for illustrating the way of winding capable of avoiding the running on tendency;

FIG. 17 is a schematic view for illustrating the way of winding capable of avoiding the aparting tendency;

FIG. 18 is a schematic vies for illustrating strokes for the quick feed and quick return at the left and right flanges of the drum.

DESCRIPTION OF THE PREFERRED EMBODIMENT

Figure 2:
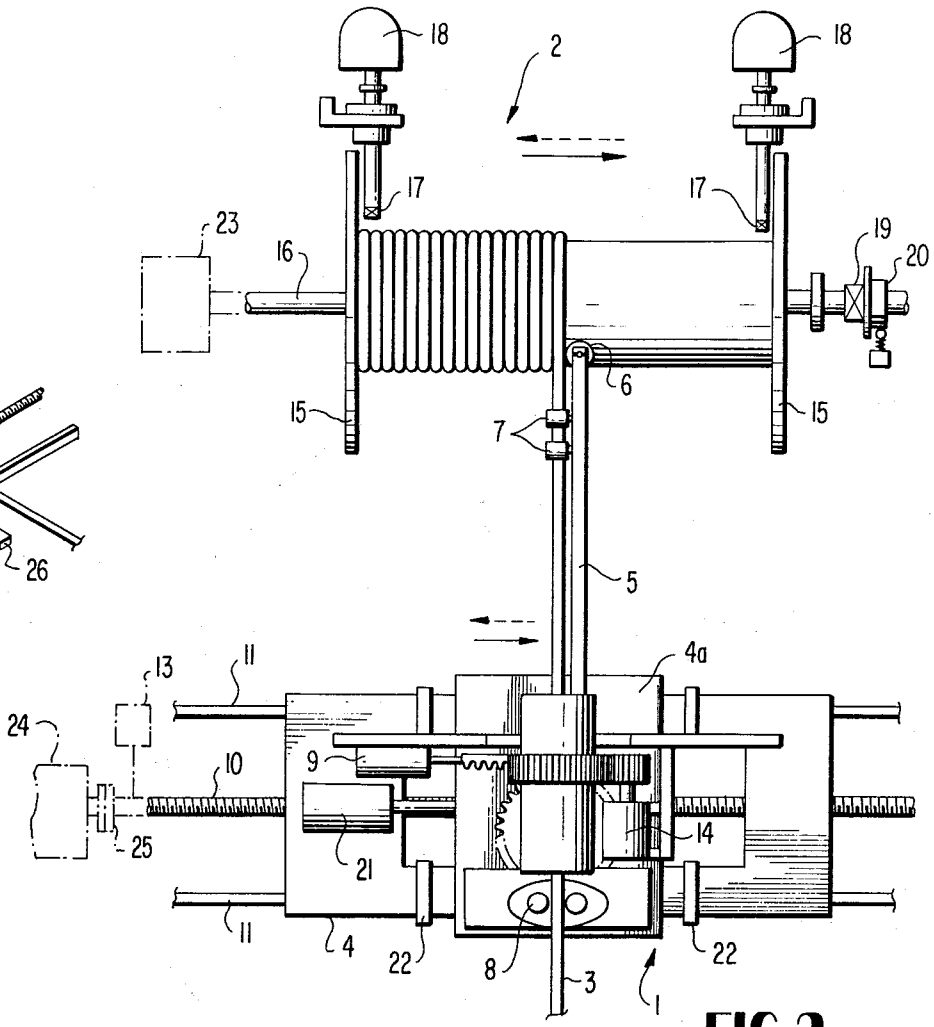
FIG. 2 is a plan view illustrating the relation between the traverse base and the drum.
Figure 1:
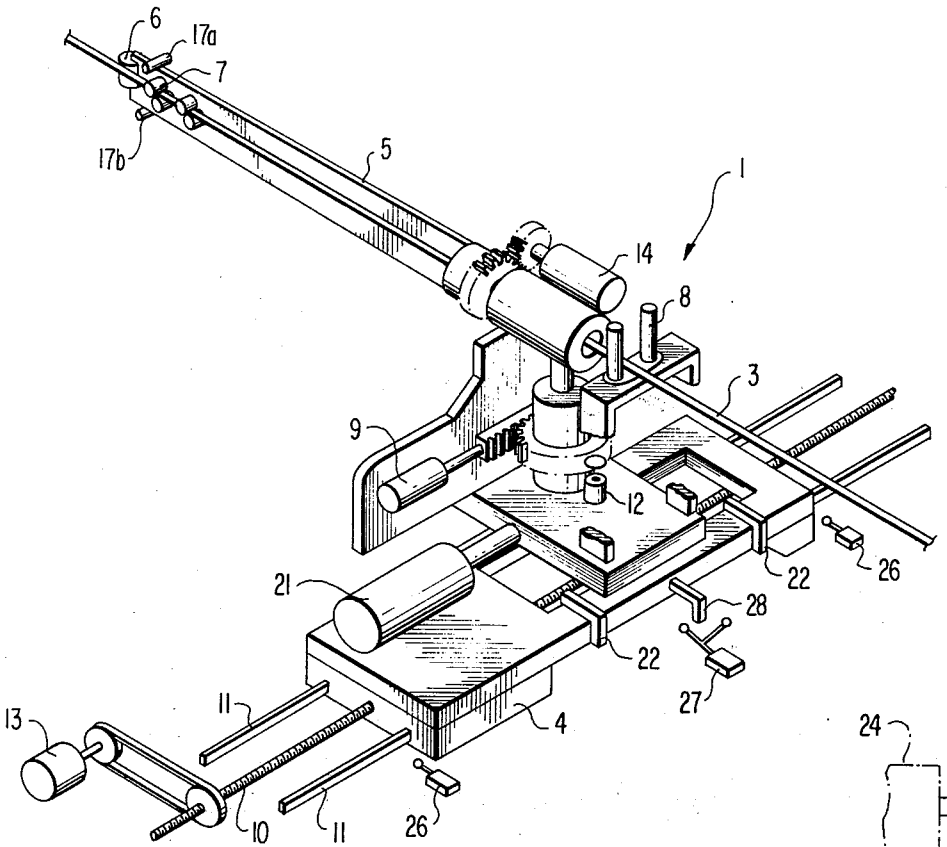
FIG. 1 is a perspective view of the traverse base of the automatic cable winding apparatus according to this invention.

Referring to the drawings which illustrate a preferred embodiment of the invention, in particular FIGS. 1 and 2, there are shown a traverse apparatus generally designated by reference numeral 1, a drum 2, cable 3, a traverse base 4, a traverse arm 5 mounted on the traverse base 4, a pressure roller 6 for pressing the cables 3 sideways, guide rollers 7 that guide the cables 3 while supporting them at the upper and the lower sides thereof, an air cylinder 9 which applies to the traverse arm 5 the force for pressing the cables 3 sideways, a traverse shaft 10 rotated for moving the traverse base 4, traverse guides 11, a selsyn generator 12 for detecting the deviation of the traverse arm 5, a selsyn motor 13, an air cylinder 14 for turning the traverse arm 5 by 180°, flanges 15 of the drum, a rotating shaft 16 of the drum, proximity switches 17, motors, e.g., pulse motors 18 for raising the proximity switches 17, an electromagnetic clutch 19, a rotation angle detector 20, an air cylinder 21 which presses the cables 3 to the flange 15 and normally stays at an intermediate position, stoppers 22, a motor 23 for rotating the drum shaft, a motor 24 for rotating the traverse shaft and a clutch 25 for the motor 24.

In the traverse apparatus 1, the traverse arm 5 mounted on the traverse base 4 guides the cable 3 through the rollers 8 and 7 to the drum 2 and presses the cables 3 sideways near the winding surface of the drum by way of the roller 6 provided at the top thereof. The sideway force of said roller 6 is caused by the air supplied to the air cylinder 9. More specifically, the pneumatic pressure of the supplied air is applied to the fulcrum support of the traverse arm 5, and pushes back the portion containing the roller 6 centering around the fulcrum by the torque force in the direction opposite to that of the cable winding. This force is applied to the cables 3 and presses them sideways. The width of the roller 6 is desirably wider than the outer diameter of the cable 3.

As the drum 2 is rotated by the motor 23 and the cables 3 are wound around the drum 2. The traverse apparatus 1 is moved by the reversible motor 24 in the direction shown by the solid arrow adjacent drum 2, and the cables 3 are wound closely while being pressed sideways by the roller 6 of the traverse arm 5. During the winding, the errors in the outer diameter of the cable 3, etc. are detected by the selsyn generator 12 and they are corrected by controlling the selsyn motor 13 with the detection signals from said generator.

Limit switches 26 are provided as shown in FIG. 4 for detecting when the traverse base 4 has moved to a position whereby the cable 3 is wound up to the vicinity of the flange 15. The limit switches 26 are spaced apart from each other a distance corresponding to the distance between the flanges 15. The spacing can be adjusted by a motor. (not shown).

As best illustrated in FIG. 3, the traverse block and arm is raised an amount equal to the outer diameter of the cable 3 by a motor, etc. at each completion of the winding of one layer of the cable 3. Reference numeral 30 denotes a disc and 31 denotes a brake for braking the rotation of the disc 30 and actuates on the quick feeding and quick return of the traverse arm 5.

The apparatus having the foregoing construction operates in the manner described below. When a push button for the starting of the automatic winding is actuated, motors 23 and 24 rotate and the traverse base 4 is moved in the direction of the solid arrow when the cables 3 are to be wound from the left to the right ends of the drum 2. Air is supplied to the air cylinder 9 to rotate the traverse arm 5 from its reference position, which is detected by the selsyn generator 12. The detected signals drive the selsyn motor 13 to move the traverse base 4 so that the traverse arm 5 comes to situate at its reference position. This operation is effected while disconnecting the traverse shaft 10 from the motor 24 by way of clutch 25 but the traverse shaft 10 can be driven either by the motor 24 or by the selsyn motor 13 by employing a planetary gear mechanism.

The preparation for starting the winding is thus completed with the operations described above, the traverse base 4 is moved in the direction of the solid arrow at a predetermined speed, and the cables 3 are wound sequentially on the drum 2. When the traverse arm 5 for pressing the cable sideways deviates from its reference position due to the errors in the diameter of the cables 3 during winding, the deviation is detected by the selsyn generator 12 as described above and the detected signals drive the sylsyn motor 13 to adjust the advance or the delay of the traverse base 4. The cables 3 can thus be prevented from running on or generating clearance between them during winding.

When the cables are closely wound sequentially on the drum 2 as in the foregoing, and the traverse base 4 is moved to the vicinity of the flange 15 of the drum, this approach is detected by the limit switches 26 and the detection signals generated therefrom removes the air pressure applied to the air cylinder 9 and supplies air to the air cylinder 14 thereby turning the traverse arm 5 by 180°.

When the turning of the traverse arm 5 is completed, air is supplied again to the air cylinder 9 and the sideway force for pressing the cables 3 against the flange 15 of the drum is applied by the roller 7.

When the proximity switch 17 detects that the cables 3 are wound near to the flange 15, its detection signal causes the traverse base 4 to stop and also raises proximity switch 17 by a motor 18 by the height of the outer diameter of the cable 3. They further energize the electromagnetic clutch 19 to combine the rotation angle detector 20 with the drum rotation shaft 16.

This rotation angle detector 20 is adapted so that it provides a detection signal input when the drum 2 rotates by a predetermined angle, for example, 1.⅝ – 1.⅞ of a revolution, and it can consist of various types of structures, such as a pulse counter or a combination cam and limit switch and the like.

During the operation of the rotation angle detector 20, high pressure air is supplied to the air cylinder 9 to move the traverse arm 5 to the right thereby pressing the cables 3 against the flange 15 of the drum by way of the roller 6.

When the rotation angle detector 20 detects that the drum 2 has rotated by a predetermined rotation angle, the detection signals generated therefrom cause disengagement of electromagnetic clutch 19 and reversal of the rotating direction of motor 24 thus starting the movement of the traverse base 4 in the direction of the dotted arrow. The traverse block **4*a* is controlled by controlling the air supplied to the air cylinder 21 so that the block 4*a* temporarily moves in the direction of the dotted arrow rapidly and, thereafter, returns to its initial position, that is, to a center position between stops 22 as controlled by the air cylinder. This prevents the cable 3 from being wound sequentially on the the flange 15. The control on the air cylinder 21 can be achieved by the operation of timers depending upon the rotation speed of the drum 2**.

At the same time with such turning back operation of the winding direction of the cables 3, the traverse block and arm is raised by an elevating device actuated by hydraulic pressure, pneumatic pressure, and the like by the height equal to the outer diameter of the cable 3, which renders the angle of the cables 3 to be wound around the drum 2 always constant and ensures the sideway pressing by way of the traverse arm 5.

The proximity switches may be arranged in several different ways. In FIG. 5 which illustrates one way in which the proximity switches may be mounted, there is shown a traverse arm 35, vertical roller 36, guide roller 37, flange 45 of the drum, a proximity switch 47 of capacitance type, for example, provided within the hollow portion of the guide roller 37, needle bearings 50 which are inserted between the stepped portion of the boss of the guide roller 37 and the traverse arm 35 and rotatively support the guide roller 37.

Since the hollow portion is formed axially through the center of the guide roller 37 that supports the cable 3 from the upper and the lower sides thereof and guides them to the drum, and the proximity switch 47 which detects at the approach of the flange 45 that the cables are wound up to the flange 45 is disposed within said hollow portion, the proximity switches 47 can be disposed together with the guide roller 37 on the position where the cables can be pressed sideways near the winding surface of the drum, that is, near the vertical roller 36 mounted on the top of the traverse arm 35.

Alternatively by the provision of two proximity switches 17*a* and 17*b* (FIG. 1) on the upper and the lower portion near the end of the traverse arm 5, the proximity switch 17*a* can be situated under the traverse arm 5 when the traverse arm 5 faces to the flange 15*a* on the right with its side provided with the guide roller 7 as shown in FIG. 6 and the proximity switch 17*b* can be situated under the traverse arm 5 when the traverse arm 5 faces to the flange 15*b* on the left with the side thereof provided with said guide roller 7 as shown in FIG. 7 where the traverse arm 5 is rotated by 180°. The provision of the switching mechanism including switch 27 which can be switched on every turning operation of said base 4 and a L-shaped rod 28 provided on the traverse base 4 as shown in FIG. 1, enables actuation of the proximity switches 17*a* or 17*b* when the switches 17*a* or 17*b* are situated under the traverse arm 5 as described above.

The proximity switches 17*a* and 17*b* provided over and under the top of the traverse arm 5 can thus be adopted exclusively for the detection of approach to the flange on the left and right respectively.

When the cables 3 are sequentially wound and the thickness of the layers of the cables wound on the drum 2 become increased, the outer periphery of the drum flange 15 may be expanded in the axial direction of the drum 2 and the flange 15 if it is made of wood. The bending of the flange is due to the allowed errors in fabrication. Moreover, since the sideway pressing force of the traverse arm 5 is usually adjusted to such an extent as to avoid running on of the cables 3, it is difficult, when the flange 15 is deformed as described above, to press the cables 3 completely by the traverse arm 5 against the flange 15 without gaps, which results in the disordered windings in the vicinity of the drum flange 15.

Figure 8:
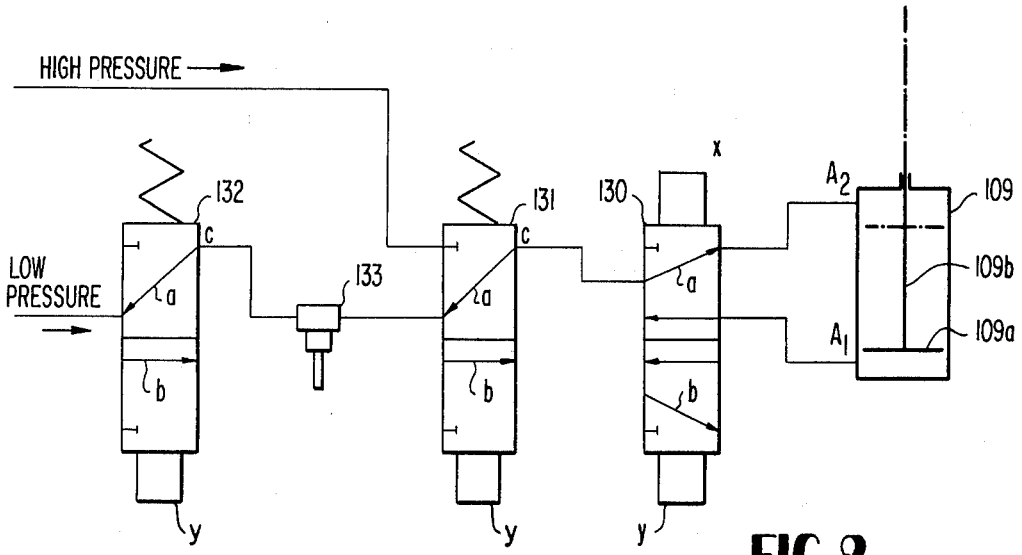
FIG. 8 is a schematic diagram for piping system which switches the pneumatic pressure between high and low pressure for feeding to an air cylinder in order to press the cables.

It is, therefore, necessary to provide means which presses the cables 3 completely against the flange 15 for closely winding the cable in order even when the outer periphery of the drum flange 15 expands axially. Such a means is shown in FIG. 8 wherein low pressure air is supplied by way of the route of "a" of an electromagnetic valve 132, pressure switch 133, a of an electromagnetic valve 131, and a of an electromagnetic valve 130, and through a port $A_2$ to an air cylinder 109 when the cables are winded toward the drum flange on the right. This situates the piston 109*a* as shown in the solid line in the figure causing the traverse arm connected with a piston rod 109*b* to press the cables sideways. When the proximity switch detects that the cables are wound near to the drum flange on the right, the magnet Y of the electromagnetic valve 130 and the magnet X of the electromagnetic valve 131 are energized to enter the high pressure air by way of the route of "*b*" of the electromagnetic valve 131 and *b* of the electromagnetic valve 130, and through the port $A_1$ to the air cylinder 109. This situates the piston 109*a* as shown in the dotted line in the figure causing the traverse arm connected with the piston rod 109*b* to press the cables firmly against the drum flange on the right while the drum rotates by a predetermined rotation angle. After the drum has been rotated by the predetermined rotation angle as described above, the magnet of the electromagnetic valve 131 is deenergized to return the valve to its initial position by the spring force. Then, the high pressure in the air cylinder 109 is applied through the port $A_1$ and by way of the route of *b* of the electromagnetic valve 130 and *a* of the electromagnetic valve 131 to the pressure switch 133. This actuates the pressure switch 133 which, in turn, energizes the magnet Y of the electromagnetic valve 132 to discharge the high pressure air through *b* of the electromagnetic valve 132. Thereafter, the cables are wound toward the drum flange on the left after the quick feed and quick return of the traverse base has been effected. In this case, the low pressure air is supplied by way of the route of *a* of the electromagnetic valve 132, pressure switch 133, *a* of the electromagnetic valve 131 and *b* of the electromagnetic valve 130 and through the port $A_1$ to the air cylinder 109 and the piston 109*a* is thereby situated as shown in the dotted line. When the proximity switch detects the approach of the flange, it energizes the magnet Y of the electromagnetic valves 131 and the magnet X of the electromagnetic valve 130 to enter the high pressure air by way of *b* of the electromagnetic valve 131 and *a* of the electromagnetic valve 130 and through the port $A_1$ to the air cylinder 109. This situates the piston 109*a* as shown in the solid line and thus the cables can be pressed firmly against the flange on the left while the drum rotates by the predetermined rotation angle. Thereafter the same operations are repeated.

The automatic operation that is carried out where the winding proceeds from a layer to the succeeding one on the inner surface of the flange of the drum is described below.

Figure 9:
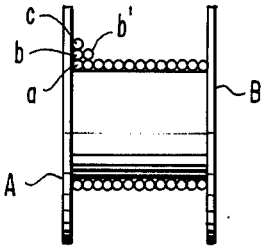
FIG. 9 is a schematic explanetary view for illustrating the winding of the cables near the flange of the drum.

FIG. 9 illustrates the manner in which the traverse block 4*a* prevents cable 3 from being wound in layer *a*, *b* and *c*. When the traverse apparatus 1 is stopped at the flange A or B, the cable 3 is wound between 1.¾ and 1.⅞ turns so as to result in overlapping windings *a*, *b* and *c*. Then, the traverse block 4*a* is quickly retracted by the air cylinder 21 to remove the top of the traverse arm 5 away from the cable thereby lowering the cable at *c* to the position *b'*. Thereafter, the traverse block 4*a* is advanced to press the cables 3 sideways toward *b* by the presser roller 6 at the top of the traverse arm 5 to provide the closed winding. Thereafter, the traverse apparatus 1 is moved in the reverse direction to perform the closed winding.

Figure 10:
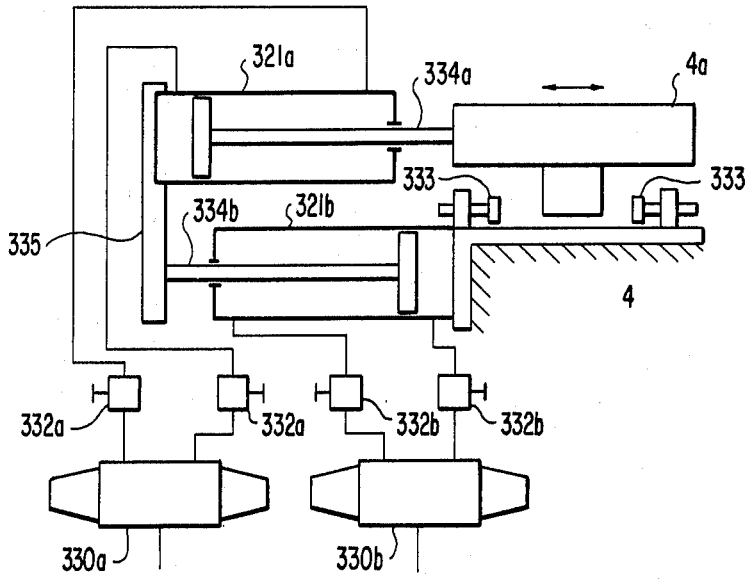
FIG. 10 is a schematic view for illustrating the disposition of a double cylinder for the quick return and quick feeding of the traverse block.

The quick return and quick feed mechanism for achieving the foregoing atuomatic operations are shown in FIG. 10 and FIG. 11 wherein the traverse block 4*a* mounted on the traverse base 4 is connected to the piston rod 334*a* of a cylinder 321*a* and said cylinder 321*a* is connected by way of a linking member 335 to a piston rod 334*b* of a cylinder 321*b* secured on the traverse base 4. In the figures there are also shown electromagnetic valves 330*a* and 330*b* for regulating cylinders 321*a* and 321*b*, control valves 332*a* and 332*b* for regulating the air feed rate to control the velocity of the piston rods 334*a* and 334*b*, stoppers 333 for restricting the movement of the traverse block 4*a* and an air supply source 336.

When the proximity switch detects that the cables 3 are wound up to the vicinity of the drum flange, the movement of the traverse base 4 is stopped and when the rotation angle detector detects, thereafter, that the drum 2 has been rotated a predetermined rotation angle, the electromagnetic valve 330*b*, for instance, is operated to supply air to the right side of the air cylinder 321*b* thereby displacing the piston rod 334*b* to the left. This causes the traverse block 4*a* to move quickly to the left till it abuts the stopper 333 by way of the linking member 335 and the cylinder 321*a* in which the air is supplied to the left side portion. The stroke of the traverse block can be determined by the position of the stopper 333. The movement of the traverse block 4*a* carries the cable in the direction aparting from the flange, which prevents the cable from running on the wound layer. Then, with the return of the electromagnetic valve 330*b*, air is supplied to the left side portion of the cylinder 321*b* to return the traverse block 4*a* to its intermediate position. The cables which has once been separated from the flange can thus be moved again toward the drum flange, closely contacted and, thereafter, sequentially wound around the drum as the traverse base moves.

When the cables are wound up to the vicinity of another drum flange on the opposite end, the cylinder 321*a* and the electromagnetic valve 330*a* are actuated just in the same manner as described above. As apparent from the foregoing, the intermediate position of the traverse block 4*a* corresponds to those of the piston rods 334*a* and 334*b* shown in the figure, which means that air can be fed to either of the cylinders 321*a* and 321*b* and therefore that easy and reliable control can be attained.

In winding cables near the drum flanges, it is required to change the operation of the quick return and feed mechanism between right and left flanges depending upon the direction of the cable twisting, because the twisted cables tend to displace to the right or left depending on the component of the force excerted in the direction of untwisting the cables. Desirably, the times for quick feed and quick return may be altered or the velocity or stroke thereof may be differed. The times can be adjusted by providing timers having different working times to the electromagnetic valves 330*a* and 330*b* respectively and the velocity can be optionally controlled by the adjustment of the control valves 332*a* and 332*b*. The stroke of the movement can be different between right and left by adjusting the positions of the stoppers 333.

In the foregoing embodiment, the air cylinders 321*a* and 321*b* are disposed side by side and connected to each other with the linking member 335, but they can of course be disposed on a straight line by directly connecting the piston rod 334*b* of the cylinder 321*b* with the cylinder 321*a*. Also, various arrangements other than that shown in FIG. 11 can be employed for the electromagnetic valves 330*a* and 330*b*.

As described above, two air cylinders are disposed connected in series with each other for quickly returning and feeding of the traverse block on the traverse base when the cables are wound up to the vicinity of the drum flange, each being adapted for the exclusive control near the drum flange on the right and left respectively, said traverse block being able to be kept at the intermediate position when air is fed to either of the two cylinder, and the stroke for the quick feed and quick return being able to be controlled by adjusting the position of the stoppers provided on the right or left side. Thus, if the cables show different winding characteristics in the vicinities of the drum flange on the right and left due to their twisting direction, they can be wound properly by controlling two air cylinders that exclusively operates for the drum flange on the right and left side in different manner corresponding thereto.

In another embodiment, a dual cylinder can be used for the quick feed and quick return of the traverse arm 5 and such a dual cylinder construction is shown in FIG. 12.

In advancing or retracting quickly the traverse arm mounted to the traverse block near the drum flange by way of a dual cylinder as shown in FIG. 12 and FIG. 9, air is fed from an aperture 422 into an inner air cylinder 417 and discharged through an aperture 423 when the cable is wound on the position *c* at the inner side of the drum flange A. This moves the piston 418 in the direction of an arrow 424 and, therefore, quickly retracts the roller 6 at the top of the traverse arm 5 mounted on the traverse block 4*a* to thereby release the cable pressed at the position *c*. The cable released moves from the position *c* to position b′. Then, air is supplied from the aperture 423 into the inner cylinder 417 and discharged through the aperture 422. This moves the piston 418 in the direction of an arrow 426, thereby advancing the roller 6 at the top of the traverse arm 5 toward the flange A to press the cable as previously described. In a similar manner, when the cable comes close to the inner side of the drum flange B, air is supplied and discharged through the apertures 420 and 421 while introducing air from the aperture 423 into the inner cylinder 417 to press the piston against the bottom of the cylinder 417, thereby actuating the piston 416 of an outer air cylinder 415. Thus, the roller 6 at the top of the traverse arm 5 mounted to the traverse block 4*a* is quickly advanced and retracted.

Since the quick advance and retraction of the roller 6 at the top of the traverse arm 5 mounted on the traverse block 4*a* toward the flange of the drum is performed by the use of a dual cylinder with each of the cylinder portions being exclusively used for the respective operation near the flanges of the drum on opposite ends, said quick advance and quick retraction can be achieved positively.

The foregoing double cylinder or dual air cylinder construction can be replaced with suitable cam mechanisms and one of the mechanisms is shown in FIG. 13*a*, wherein cables 501, drum 502 for winding the cables, flanges 503 and 503′ of the drum are shown. A traverse base 504 is adapted to move to right and left by the clockwise or counter-clockwise rotation of the traverse screw shaft 505 on the traverse base in the direction of an axis of said screw by a short distance. A traverse arm 507 is provided for guiding the cables 501 to the winding surface of the drum 502 and pressing said cables sideways by way of a presser roller 508 mounted at its top. The traverse arm 507 is provided with gearing mechanisms for rotating the arm in the horizontal plane relative the traverse block 506 as well as for turning the arm around its axix by 180°. Arcuate grooves 509 and 510 are formed in a cam plate 516 in such a manner that they communicate with each other at both ends 511 and 512 and the communicating portions 513 and 514 on said both ends 511 and 512 situate on the opposing sides respectively with each other relative to the center line 515. The cam plate 516 is adapted to move along the center line 515 in the directions of arrows 519 and 520 by way of a piston rod 517 and an air cylinder 518 secured to one end thereof. A rod 521 is fixed to the traverse block 506 at one end and provided at its top end with an engaging portion 522 for engaging the grooves and including ball bearings. The engaging portion 522 is adapted to engage the arcuate grooves 509 and 510 and pass through the arcuate groove 509 when the plate cam 516 is pulled back in the direction of an arrow 519 due to the movement of said plate cam 516 along the center line 515 and pass through the arcuate groove 510 when the plate cam 516 is pushed forward in the direction of an arrow 520. The latter movement is dependent upon the configuration of the communicating portions 513 and 514 at the both ends of the grooves 509 and 510. The movement of the cam mechanism quickly advances and retracts the traverse block 506, traverse arm 507 mounted to said block and the press roller 508 at the top thereof in the direction of arrows 523 and 524, that is, perpendicular to the flange of the drum.

In FIG. 13*a* the cam mechanism is in such a state where the cam plate 516 is pulled back by the air cylinder 518 in the direction of the arrow 519 thus situating the engaging portion 522 at one end 511 of the arcuate groove 509. For performing the automatic close winding of the cables in order near the flange in this state, cables 501 are wound on the drum 502 by rotating the drum and when they are wound up to the vicinity of the flange 503 of the drum, the movement of the traverse base 504 is stopped. Meanwhile, the drum continues to rotate and take up the cables 501. By rotating the drum by 1.¾ – 1.⅞ turns while pressing the cables 3 onto the inner surface of the flange 503 by the press roller 508 provided at the top of the traverse arm 507, the cables 501 are stacked in two layers such as 551*a* and 551*b* as shown in FIG. 13*b*. Then, in this state, wherein the engaging portion 522 of the traverse block 506 engages into one end 511 of the cam groove 509 of the cam plate 516, the cam plate 516 is pushed forward in the direction of the arrow 520 by actuating the air cylinder 518. Then, the engaging portion 522 moves along the groove 509, which quickly retracts the traverse block 506 and the roller 508 at the top of the traverse arm 507, fixed to said block, in the direction of the arrow 573 shown in FIG. 13*b*. That is, roller 508 moves in the direction away from flange 553 until the portion 522 arrives at the intermediate position 525 of the arcuate groove 509. The rapid retraction of the presser roller 508 results in the falling of the second layer cable 551*b* to the level of the first layer and the cable 551*b* moves to the position 551*c*. Since the cables 551 are rigid, they tend to form a gap between the cable 551*a* when they come to situate at the position 551*c* on the first layer. In order to avoid this, the traverse block 506 and the roller 508 at the top of the traverse arm 507 are quickly advanced in the direction of an arrow 574 by passing the engaging portion 522 through the latter half of groove 504. Thus as portion 522 traverses groove 504 from the intermediate point 525 to the end 512 the roller presses cable 551*c* against the cable 551*a* to eliminate gaps in the winding. The traverse base 504 is thereafter moved in the opposing direction and the cables 501 are taken up into the drum toward the flange 503′ thereof. When they approach flange 503′, the traverse block 516 is pulled back by actuating the air cylinder 517 causing the engage portion 522 to pass through the groove 510 from the end 512 to the end 510 resulting in the similar operation as described above.

In this embodiment, the quick advance and retraction of the traverse block and the like is attained by the use of the arcuate cam and it ensures the reliable automatic winding of the cables in order in the vicinity of the flange of the drum.

The cables to be wound around the drum tend to either run on or apart from the preceeding cable as described above because of and depending upon their twisting direction or habit of winding and the direction of winding even if the position to which cables are guided for winding and the position of the traverse base properly corresponded. In a preferred embodiment of this invention, the detection level for the deviation of the traverse arm 5 between the right and left sides may be different and, corresppondingly, the amount of correction for the movement of the traverse base 4 may differ for movement in opposite directions. Similarly, amount of the stroke for the quick feed and quick return of the traverse block may differ depending upon the twisting direction of the cables. In the winding condition shown in FIG. 14, for example, the cables 3 tend to run on and, therefore, the movement of the traverse base 4 is controlled in advanced manner as shown in FIG. 16 and the detection level for the deviation angle of the traverse arm 5 is determined corresponding thereto. On the contrary, in the winding condition shown in FIG. 15, for example, the cables 3 tend to move apart from the preceeding cable and, therefore, the movement of the traverse base 4 is controlled in the delayed manner, that is, in a manner that the cables would tend to run on the preceeding cable if there were not the component force due to the twisting direction of the cables 3. As shown in FIG. 18, when the cables 3 are wound around the drum up to the vicinity of the flange 15 on the right side, the traverse block 4*a* is quickly returned and fed with a larger stroke in order to offset the component force due to the twisting direction of the cables 3 which tends to approach the flange 15 and, at the flange on the left side, the traverse block 4*a* is quickly returned and fed with a smaller stroke so as to offset the component force due to the opposite twisting direction of the cables which tends to move apart from the flange of the drum thereby achieving the formation of the succeeding layer of winding. The control of the foregoing stroke can be attained by adjusting the positions of the stoppers 22 for the traverse block 4*a* so as to fit the twisting direction of the cables. The foregoing control for the feeding of the traverse base 4 can be attained by properly setting the start timing for the change of the moving direction of the traverse base 4, and the sensitivity for detecting the deviation angle of the traverse arm 5.

Figure 19:
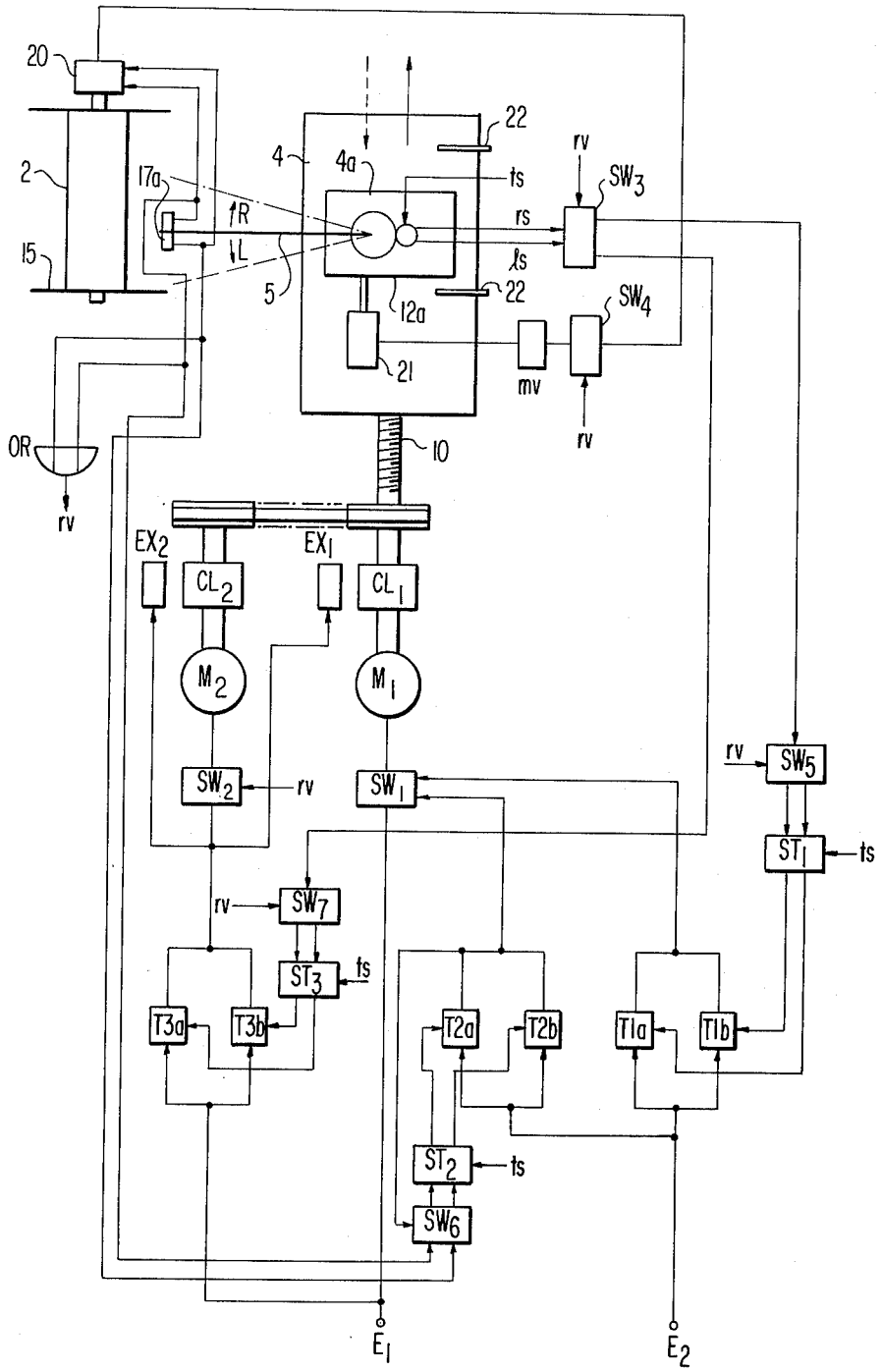
FIG. 19 is a diagram of a controlling circuit for winding which can offset the running on and aparting tendencies of the cables.

In FIG. 19, a control circuit for use with the embodiment for performing the foregoing controls is given, in which the traverse block 4*a* mounted on the traverse base 4 is adapted to be quickly fed and returned by the cylinder 21 and the stroke for said quick operation can be determined by the stoppers 22, the positions of which are adjustable. The traverse arm 5 is provided at the top thereof with a proximity switch 17*a* which detects the flange 15 of the drum and identifies that the cables are wound up to the flange 15. An angle detector 12*a* for the detection of the deviation of the traverse arm 5 is composed, for example, of the aforementioned selsyn generator and capable of setting its detecting sensitivity for the deviation unsymmetrically between right and left depending upon the twisting directions of the cables.

In the figure are also shown a main motor $M_1$ and an auxiliary motor $M_2$, electromagnetic clutches $CL_1$ and $CL_2$ and exciting circuits $EX_1$ and $EX_2$ therefore. The elecromagnetic clutches $CL_1$ and $CL_2$ are constructed so that they are alternately connected or disconnected. For example, when current is supplied to the exciting circuits $EX_1$ and $EX_2$ for the electromagnetic clutches $CL_1$ and $CL_2$, the clutch $CL_1$ is disconnected while the clutch $CL_2$ is connected. The rotation speed of the traverse shaft 10 given by the auxiliary motor $M_2$ is set higher than that given by the main motor $M_1$.

When the proximity switch 17*a* detects the approach of the flange 15 of the drum, it actuates the rotation angle detector 20 for the drum 2 and generates turning signals rv by way of an or circuit OR. The turning signals rv cause switching circuits $SW_2$, $SW_3$, $SW_4$, $SW_5$ and $SW_7$ to operate the switching actions. T1*a*, T1*b*, T2*a*, T2*b*, T3*a* and T3*b* denote timers and the outputs from the timers T1*a*, T1*b*, T2*a* and T2*b* operate the switching circuit $SW_1$ and the outputs from the timers T2*a* and T2*b* operate the switching circuit $SW_6$.

Timers T1*a* and T1*b* are for placing the switching circuit $SW_1$ in off condition during their output period to stop the main motor $M_1$ and the timers T2*a* and T2*b* are used for shifting the switching circuit $SW_1$ to off during their output period and, thereafter, causing it to operate the switching action for reversing the main motor $M_1$. Setting circuits $ST_1$ – $ST_3$ are set with the setting signals ts corresponding to the twisting direction of the cables, and the advanced or delayed control is effected for the movement of the traverse base in accordance with the contents of the above described setting. MV is an electromagnetic valve for controlling the air cylinder 21, $E_1$ is electrical power source for the main and auxiliary motors $M_1$ and $M_2$ and $E_2$ is a contol power source.

When the traverse base 4 is moved by the main motor $M_1$ in the direction of a solid arrow and the cables are wound around the drum 2 while being pressed sideway by the traverse arm 5, and when the approach of the flange 15 of the drum 2 is detected by a proximity switch 17*a*, a rotation angle detector 20 is started by the detection signals and either of the timers T2*a* and T2*b* is started by way of the switching circuit $SW_6$ and setting circuit $ST_2$ depending upon the switching condition of the setting circuit $ST_2$. Where the cables 3 are wound up to the vicinity of the flange 15, for instance, in the direction shown in FIG. 16 and the timer T2*a* is started, timers T2*a* and T2*b* are previously set so that the setting times thereos t2*a* and t2*b* satisfy the relation $t2a > t2b$. Therefore, the switching circuit $SW_1$ is conditioned to off and hence the main motor is stopped thereby stopping the feed of the traverse base 4 in the direction of the solid arrow during said set time *t2a*.

While the feed of the traverse base is stopped, the rotation angle detector 20 detects that the drum 2 has rotated a predetermined rotation angle, and the detection signals control the electromagnetic valve MV by way of the switching circuit $SW_4$ to supply air to the air cylinder 21 thereby performing the quick feed of the traverse block 4*a* in the direction of the dotted line and then the quick return in the direction of the solid arrow. The stroke for the quick feed and return is set smaller than that performed at the flange on opposite side by adjusting the position of the stopper 22. At the same time, the switching circuits $SW_2$, $SW_3$, $SW_4$, $SW_5$ and $SW_7$ are caused to conduct their switching operations by the detection signals delivered from the proximity switch 17*a*.

After the set time *t2a* of the timer T2*a* has been elapsed, the switching circuit $SW_1$ is switched to on and the switching circuits are simultaneously caused to conduct the switching operation, which drives the main motor $M_1$ in the reverse direction and, in turn, the traverse base 4 in the direction of the dotted arrow. This means that the start timing for the feed of the traverse block 4 is delayed a little and thus the winding condition shown in FIG. 7 can be attained.

Where the cables 3 are wound around the drum 2 as shown in FIG. 17 and when the traverse arm 5 makes a deviation to the left shown in the dotted arrow during the time that is while the traverse base 4 is being fed in the direction of said arrow, the detection signals ls generated from the rotation angle detector 12*a* are delivered through the switching circuit $SW_3$ and by way of the switching circuit $SW_7$ and setting circuit $ST_3$ and start the timer, for example, timer T3*b*. The timers T3*a* and T3*b* are previously set so that their set times t3*a* and t3*b* satisfy the relation $t3a > t3b$. Since the traverse base 4 is to be controlled in the delayed manner in this case, if the traverse arm 5 makes a deviation as described above, the auxiliary motor $M_2$ is driven for a short period to perform high speed feed of the traverse base 4. When the auxiliary motor $M_2$ is driven, the exciting circuits $EX_1$ and $EX_2$ for the electromagnetic clutches $CL_1$ and $CL_2$ are also excited to disconnect the clutch $CL_1$ and connect the clutch $CL_2$ and, therefore, the traverse shaft 10 is driven only by the auxiliary motor $M_2$.

If the sufficient quantity of correction is not obtained for the feed of the traverse base 4 by the set time of the timer T3*b*, the rotation angle detector 12*a* detects the remaining deviation again and the foregoing correction operation is repeated. When the twisting direction of the cable is in Z-twisting being opposite to that described above, the timer T3*a* is stated by the setting of the setting circuit $ST_3$ resulting in the increased feed amount at high speed. Where the traverse base 4 is being moved in the direction of the solid arrow, that is, when the cables are wound in the direction shown in FIG. 16, timer T3*a* is started and the tendency of the cable for running on can be corrected by increasing the high speed feed quantity.

When the traverse arm 5 deviates to the right as shown in a dotted chain while the cables 3 are wound in the direction shown in FIG. 17, it means that the traverse base 4 makes too large an advance. In such a case, the detection signals rs generated from the rotation angle detector 12*a* are delivered through the switching circuits $SW_3$ and $SW_5$ and the setting circuit $ST_1$ and start the timers, for example timer T1*b*. The outputs from the timers T1*a* and T1*b* place the switching circuit $SW_1$ in off condition thereby stopping the main motor $M_1$. It is also possible to stop the rotation of the traverse shaft 10 by exciting the exciting circuit $EX_1$ for the electromagnetic clutch $CL_1$.

As described above, the traverse base 4 is stopped during the set time of the timer T1*b*, during which cables continue to be wound and the delayed control as shown in FIG. 17 can again be obtained. If the twisting direction of the cables is opposite (Z-twist), the advanced control is given to the traverse base 4. Then, the detection signals rs obtained from the rotation angle detector 12*a* are adapted to start the timer T1*a* so that the stopping period of the traverse base 4 is made longer than that described above.

When the traverse base 4 is fed in the direction of the dotted arrow and the flange 15 on the left is detected by the proximity switch 17*a*, the same operation is performed as described above. But in this case, since timer T2*a* is started thereby decreasing the stopping period of the traverse base 4 at its turning, it results in the advanced control when the base is fed in the direction of the solid arrow thereafter. The stroke for the quick feed and return is set greater than that described previously regarding the turning at the flange on the right side by the adjustment of the position of the stopper 22. It will be easily under-stood that if the cable is twisted in the opposite direction (Z-twist), the operations are performed in the contrary manner by the setting of the setting circuit and the adjustment for the position of the stopper.

In the foregoing embodiment, the electromagnetic clutches $CL_1$ and $CL_2$ can be eliminated by replacing them with a construction wherein the feeding by the main motor $M_1$ and the auxiliary motor $M_2$ is performed by mechanically meshing their rotational force for the traverse shaft using planetary gear mechanism and the like. In addition, either of the timers T1*a* and T1*b*, switching circuit $SW_5$ and setting circuit $ST_1$, either of the timers T3*a* and T3*b*, switching circuit $SW_7$ and the setting circuit $ST_3$ can also be eliminated if the rotation detector 12*a* can provide detecting sensitivity properly different between right and left depending upon the twisting direction of the cables.

In the above embodiment, the cables can be automatically wound closely in order by performing the advanced or delayed control for the traverse base and by making appropriate difference in such control when the cables are wound up to the vicinity of the flange 15 of the drum and the succeeding layer is to be formed depending upon the twisting direction or the habit of winding of the cables. The completely automated operation for winding cables around the drum can thus be attained.

While thhe invention has been described in detail and with reference to specific embodiments thereof, it will be apparent to one skilled in the art that various changes and modifications can be made therein without departing from the spirit and scope thereof.

What is claimed is:

1. Automatic cable winding apparatus comprising; a traverse base, means for traversing said traverse base in directions to wind said cable on a drum, a traverse block slidably mounted thereon, a traverse arm mounted to the traverse block for guiding cables to be wound on the drum, said arm being provided near the top thereof with guide rollers for guiding said cables while supporting them form the upper and the lower sides thereof and a presser roller pressing the cables sideways; a device for providing a pressing force to said traverse arm; proximity switch means for detecting the presence of cables being wound up to the vicinity of the flanges of the drum; means responsive to change of state of said proximity switch means for stopping movement of said traverse base; a rotation angle detector actuated by said proximity switch means for providing a rotation angle detection signal when the drum rotates a predetermined amount following said actuation; traverse block control means responsive to said rotation angle detection signal for quickly advancing and retracting said traverse block relative to the flanges of the drum; and means for raising said traverse arm by an amount substantially equal to the outer diameter of said cable every time a layer of cable is wound on the drum.

2. Automatic cable winding apparatus as defined in claim 1 further comprising means for turning the traverse arm around 180°, said means comprising limit switches responsive to said base moving close to a flange of said drum for providing a limit detection signal, an air cylinder responsive to air supplied thereto for causing said traverse arm to turn around 180°, and means responsive to said limit detection signal for controlling the supply of air to said air cylinder.

3. Automatic cable winding apparatus as defined in claim 1 wherein a hollow portion is formed axially in the center of a guide roller mounted near the top of the traverse arm and one of said proximity switches is disposed within said hollow portion.

4. Automatic cable winding apparatus as defined in claim 1 wherein said proximity switch means comprises two proximity switches provided at the upper and lower positions of said traverse arm for the respective and exclusive detection of the right and left flange of said drum.

5. Automatic cable winding apparatus as defined in claim 1 further comprising a deviation angle detector for detecting deviation of the traverse arm as the cables are wound on the drum and a motor for correcting the quantity of the movement of the traverse base in accordance with the output from said deviation angle detector.

6. Automatic cable winding apparatus as defined in claim 1 wherein said device for providing a pressing force to said traverse arm comprises, a cylinder for applying the pressing force to the traverse arm, said cylinder being provided with electromagnetic valves which normally supply lower air pressure and switch said lower pressure air to higher pressure air in response to detection signals generated from said proximity switch means indicating that the cables are wound on the drum up to the flange of the drum.

7. Automatic cable winding apparatus as defined in claim 1 further comprising a brake mechanism provided on a vertical shaft supporting the traverse arm on the traverse block for stopping the rotation of the traverse arm in the horizontal plane when the traverse block on the traverse base is quickly advanced to and retracted from the flange of the drum.

8. Automatic cable winding apparatus as defined in claim 1 wherein said traverse block control means comprises an air cylinder for quickly advancing and retracting the traverse block on the traverse base to and from the flange of the drum, said air cylinder being of the outer and inner dual air cylinder construction and comprising, a piston rod of the inner cylinder secured to one end of the traverse block and the outer side of said inner cylinder fixed to the inner side of said cylinder, whereby the traverse block base is quickly advanced to and retracted from the flange of the drum by supplying and discharging air through apertures provided on both sides of said inner and outer cylinders.

9. Automatic cable winding apparatus as defined in claim 1, wherein said traverse block control means comprises two air cylinders for quickly advancing and retracting the traverse block on the traverse base, a piston rod of said second air cylinder being connected to said first air cylinder.

10. Automatic cable winding apparatus as defined in claim 1 further comprising means for adjusting, depending upon the twisting direction or habit of winding of the cables to be wound around the drum, the position of the traverse base, the stopping period of the traverse base at flanges of the drum on the right and left ends, and the amount of stroke when the traverse block on the traverse base is quickly advanced or retracted.

* * * * *